US007013811B1

(12) United States Patent
Sebasto et al.

(10) Patent No.: US 7,013,811 B1
(45) Date of Patent: Mar. 21, 2006

(54) SABOT FOR REDUCING THE PARASITIC WEIGHT OF A KINETIC ENERGY PROJECTILE

(75) Inventors: Anthony Sebasto, Budd Lake, NJ (US); Stewart Gilman, Budd Lake, NJ (US); Leon Manole, Great Meadows, NJ (US); Mohan Palathingal, Oradell, NJ (US); Robert Marchak, Bloomfield, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 322 days.

(21) Appl. No.: 10/604,576

(22) Filed: Jul. 31, 2003

Related U.S. Application Data

(60) Provisional application No. 60/320,096, filed on Apr. 8, 2003.

(51) Int. Cl.
*F42B 13/16* (2006.01)

(52) U.S. Cl. ..... 102/521; 102/520; 102/522; 102/523

(58) Field of Classification Search ..... 102/520, 102/521, 522, 523
See application file for complete search history.

(56) References Cited

U.S. PATENT DOCUMENTS 3,853,057 A * 12/1974 Rickert et al. ..... 102/373

(Continued)

OTHER PUBLICATIONS

Science & Technology Review: Science and Technology to Defend Our National Interests, May 1999, p. 6.*

*Primary Examiner*—Michael J. Carone
*Assistant Examiner*—Gabriel Sukman
(74) *Attorney, Agent, or Firm*—Michael C. Sachs; John F. Moran

(57) ABSTRACT

An energetic sabot allows part of the sabot to burn away at a controlled rate, adding propellant energy to the gun while at the same time completely support the projectile rod. The energetic sabot is thicker or larger at shot start to support the projectile without breaking. As the energetic sabot travels up the gun tube, the energetic sabot then thins out or otherwise decreases in mass as the force on the energetic sabot decreases. The weight of the projectile consequently decreases as it travels up the gun tube, allowing the gun gases to push a lighter projectile, giving the projectile a higher velocity. Due to its continually decreasing weight in the gun tube, the projectile experiences greater acceleration and exits the gun with a higher muzzle velocity. A secondary effect comes from increased pressure in the gun tube from the gases relinquished in the burning of the sabot, further increasing the velocity of the projectile. This higher velocity in turn leads to greater projectile velocity at target impact, and thus a greater penetration depth. The energetic sabot is "doped" with energetic materials by sprinkling either explosive, propulsive, or pyrotechnic agents between layers of the composite material in the energetic sabot. These agents ignite upon propulsion; their composition is determined from their burn rates. The burn rate may be designed proportional to the decrease in chamber pressure; the less pressure in the tube, the more material that can be relinquished.

6 Claims, 2 Drawing Sheets

U.S. PATENT DOCUMENTS 4,598,644 A * 7/1986 Romer et al. ..... 102/521
4,936,220 A * 6/1990 Burns et al. ..... 102/521
4,967,668 A * 11/1990 Warren ..... 102/522
5,183,961 A * 2/1993 Campoli et al. ..... 102/439
5,277,096 A * 1/1994 Campoli et al. ..... 86/1.1
5,277,120 A * 1/1994 Campoli et al. ..... 102/470
5,277,121 A * 1/1994 Campoli et al. ..... 102/521

* cited by examiner

SABOT FOR REDUCING THE PARASITIC WEIGHT OF A KINETIC ENERGY PROJECTILE

FEDERAL RESEARCH STATEMENT

The invention described herein may be manufactured and used by or for the Government of the United States for governmental purposes without payment of any royalties thereon.

BACKGROUND OF INVENTION

The present invention generally relates to the field of military ordinance. In particular, it relates to a new sabot design for use in Kinetic Energy (KE) projectiles, which reduces the parasitic weight of the sabot upon launch and transforms the parasitic weight into propulsion gases that provide a greater velocity to the projectile.

Kinetic Energy (KE) projectiles are well known in the ammunition community and are made in small, medium and large caliber from 20 to 120 mm. FIGS. 1 and 2 illustrate cross sectional views of KE projectiles 10 and 205 with two types of sabots 15 and 210. The standard sabot 15 (also referenced as pusher sabot 15) is illustrated in FIG. 1, and the puller sabot 210 is illustrated in FIG. 2. Both the standard sabot 15 and pusher sabot 210 are well known in the ammunition community.

Sabots are attached to the projectile rod by threads or buttress grooves. The function of a sabot is to fill the space between the gun tube and the projectile rod and, along with the obturator (i.e., a plastic ring that attaches to the back of the sabot), prevent propellant gases from blowing past the projectile. The sabots also support the rod during gun launch as it travels up the gun tube. The sabots are usually made of three pieces or petals that are discarded from the rod as soon as the projectile exits the gun tube and gets past the gun gases.

A retaining ring (not shown) is imbedded in the front and back of the sabot. This retaining ring holds the petals of the sabot together.

When the projectile is launched from the gun tube, the scoop in front of the sabot captures the air and therefore a force is exerted on the sabots. When the force exceeds the strength of the retaining rings, the retaining ring breaks allowing the petals of the sabot to come apart and move away from the projectile rod. After the sabot is discarded, the projectile rod, nose and fin travel to the target (the projectile rod, nose and fin are known as the in-flight projectile and when the sabots are attached the projectile is known as the in-bore projectile). The target is usually protected with heavy armor. The projectile rod penetrates the target utilizing the very high velocity (kinetic energy) at which the rod is traveling. An increase in projectile rod velocity increases the armor thickness that the rod can penetrate.

Currently, the standard sabot used in ammunition is considered "parasitic weight". The sabot's sole function is to act as a carrier of the penetrator during launch. The sabot mates with the penetrator and provides a pushing surface for gun gasses to push the projectile out of the gun tube. The projectile exits with a specific muzzle velocity, and flies towards its target. Generally speaking, the greater the penetration, the more lethal the projectile, and the greater the muzzle velocity of the projectile, the greater the penetration. The sabot is necessary because it ensures that the greatest possible force is applied to the penetrator by the gases caused during the propellant ignition phase of the interior ballistic event. However, after the projectile leaves the gun tube, the sabot is discarded, allowing the penetrator to fly freely towards its target.

The in-bore projectile is part of a cartridge assembly (not shown) that holds the projectile to allow chambering into the gun tube and also contains the propellant and primer. When the soldier wants to fire the projectile, an electrical signal is sent that ignites the primer. The flame spread from the primer sets off the propellant that creates high-pressure gases. When the force of the gases exceeds the force to push the projectile and obturator, the projectile begins to move at a very high velocity.

The sabots are typically made of very strong materials such as aluminum (7076 T6) or ultem composites reinforced with carbon fiber. Sabots are subject to very high shock loads known as setback or g forces when the projectile is launched in the gun. They are therefore designed to meet these forces without breaking when fired from a gun. Setback forces can be as high as 70,000 g"s for some KE projectiles. Gun pressures can be as large as 103,000 psi for large caliber systems.

At shot start, which term is used to reference when the projectile begins to move, the projectile sees an increase in gravitational (or G–) forces, G"s, and pressures as it travels down the gun tube until the maximum G and maximum base pressure on the projectile is reached. This takes place usually within the first ⅓ of the length of the gun tube.

Then, as the projectile travels up the remainder of the gun tube, the pressures and forces on the projectile decrease rapidly to a fraction of their maximum value. The problem of parasitic weight comes into play between the moments when the peak force and pressure is reached inside the tube and when the projectile exits the gun tube. The sabot is structurally designed to withstand the maximum force and pressure reached inside the gun tube. However, after the maximum pressure is reached the pressure decreases, and the extra mass of the sabot needed to with-stand the peak values becomes superfluous.

Not only does this extra mass become unnecessary, it becomes a hindrance in that it limits the acceleration of the projectile in the tube. While the extra mass is needed to withstand the maximum force and pressure values, some of this mass becomes almost completely parasitic as the forces and pressures decrease. Since the sabot is typically between 25–30% of the total projectile mass, considerable energy is wasted during launch. It has been estimated that up to 2 lbs of the sabot is not needed after peak pressures and G forces are achieved.

What is therefore needed is a method to reduce the parasitic weight of the projectile without compromising its structural integrity. The need for such a system has heretofore remained unsatisfied.

SUMMARY OF INVENTION

The energetic sabot of the present invention satisfies this need by allowing selected parts of the sabot to burn away at a controlled rate as it travels up the gun tube. This adds propellant energy (gases) to the gun while at the same time completely supporting the projectile rod. Only selected parts of the sabot are energetic and can burn. The energetic sabot is thicker or larger (the sabot is still the same size as any other standard sabot) at shot start to support the projectile without breaking. As the energetic sabot travels up the gun tube, the energetic portion of the sabot burns off therefore thinning out or otherwise decreasing the sabot mass as the force on the energetic sabot decreases. The weight of the projectile consequently decreases as it travels up the gun tube, allowing the gun gases to push a lighter projectile, giving the projectile a higher velocity.

The energetic part of the sabot utilizes energetic material to establish dynamic weight reduction during the firing event. The energetic sabot allows for maximum efficiency and productivity of propellant in medium and large caliber sabots. To withstand the peak chamber pressure, a sabot initially needs a significant amount of strengthening material. However, as the pressure in the chamber decreases the stress on the sabot decreases. Hence, less reinforcing material is needed. Any material not needed for ensuring structural integrity is burned off the energetic sabot. When the projectile is nearing its exit from the gun tube, chamber pressure is at a minimum, and even less material is needed to ensure structural integrity of the energetic sabot. For maximum performance of the energetic sabot, all unnecessary material is burnt off by the time the projectile exits the gun tube.

Due to the continually decreasing weight of the sabot, which is part of the overall projectile, in the gun tube, the in-bore projectile experiences greater acceleration and exits the gun with a higher muzzle velocity. This higher velocity in turn leads to greater in-flight projectile velocity at target impact, and thus a greater penetration depth.

Another important effect emanates from extending higher pressures over a longer time period on the projectile in the gun tube from the gases relinquished in the burning of the sabot. With a normal sabot the pressure reaches a maximum value and then falls rapidly. This imparts only a small amount of energy to the projectile after maximum pressure is achieved.

As the energetic part of the sabot begins to burn after peak pressure, the gases that are given off causes the pressures to fall off slower. These higher pressures over time provide more energy to the system (gun/projectile) and therefore provide more velocity to the projectile.

The maximum pressure of the gun and therefore the safety of the system is not compromised since the maximum pressure for a normal sabot and a energetic sabot are the same. It is only the rate at which the pressure decreases that is effected. The sustained greater pressure in the tube over time leads to an increased amount of energy transferred to the in-bore projectile, resulting in an even greater muzzle velocity and target penetration depth. Greater in-bore velocity always translates to greater in-flight velocity for properly discarding KE sabots.

The structure of the energetic sabot may not differ significantly from the standard sabot designs, except for its composition. While most sabots are made of composite materials, the energetic sabot contains energetic materials intermixed with composites in key areas of the sabot that are intended to burn away at a controlled rate as it proceeds up the gun tube. These energetic composites are made from propellant or pyrotechnic energetic agents added to composite materials in the energetic sabot.

The energetic composites have controlled burn rates that are manufactured to match the rate needed to burn away and still have the proper support for the sabot. The composition of the energetic composites is determined from their burn rates. A deterrent coating (numerous conventional or available coatings are available and may be used in the propellant industry and are applicable for use on the energetic sabot) may be placed on the outside of the energetic composite to delay its burning until after maximum pressure is reached in the gun tube.

An ideal burn rate would allow the maximum amount of material to burn off while retaining structural integrity. In other words, the burn rate is proportional to the decrease in chamber pressure; the less pressure in the tube, the more material that can be relinquished. Some examples of potential explosive agents comprise RDX, CL20, or HMX. Examples of propulsive agents comprise M14, benite, and black powder.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein.

It should be understood that the sizes of the different components in the figures are not necessarily in exact proportion or to scale, and are shown for visual clarity and for the purpose of explanation.

DETAILED DESCRIPTION

Figure 1:
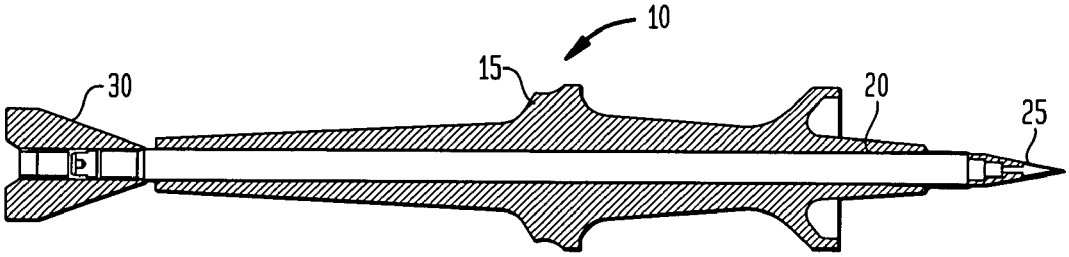
FIG. 1 (PRIOR ART)
FIG. 1 is a cross-sectional, side view of a KE projectile with standard sabot using a prior art design.
Figure 2:
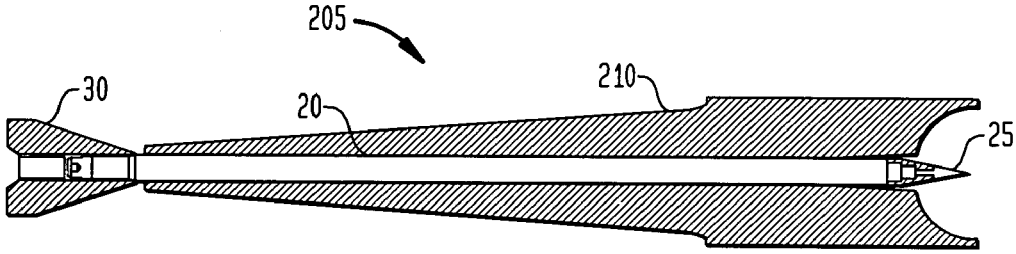
FIG. 2 (PRIOR ART)
FIG. 2 is a cross-sectional, side view of a KE projectile with puller sabot using a prior art design.

FIG. 1 is a cut-away profile view of a prior art kinetic energy tactical projectile 10 using a standard sabot 15. The kinetic energy tactical projectile 10 is comprised of a sabot 15, a projectile rod 20, a nose 25, and a fin 30. FIG. 2 is a cut-away profile view of a prior art kinetic energy tactical projectile 205 using a puller sabot 210. The kinetic energy tactical projectile 205 is comprised of a puller sabot 210, a projectile rod 20, a nose 25, and a fin 30.

Figure 3:
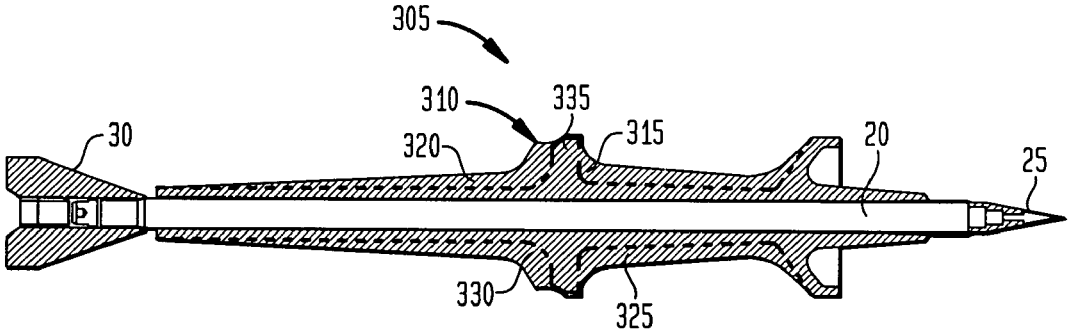
FIG. 3 is a cross-sectional, side view of a KE projectile with an energetic sabot illustrating energetic regions.
Figure 4:
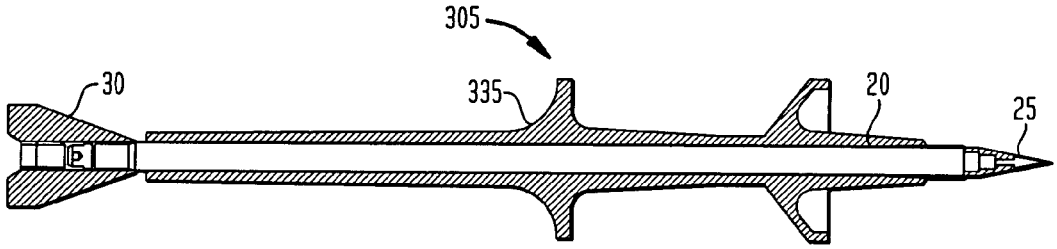
FIG. 4 is a cross-sectional, side view of a KE projectile with an energetic sabot after energetic regions have burned away.

FIG. 3 and FIG. 4 are cut-away profile views of a kinetic energy projectile 305 with an energetic pusher sabot 310. FIG. 3 illustrates the size of the energetic pusher sabot 310 needed for shot start. Energetic regions 315, 320, 325, 330 are the part of the energetic pusher sabot 310 no longer needed for support as the energetic pusher sabot 310 travels up the gun tube (not shown). After energetic regions 315, 320, 325, 330 are burned away, the energetic pusher sabot 310 is reduced to the pusher sabot base 335. The pusher sabot base 335 (FIG. 4) is the size of energetic pusher sabot 310 required after the kinetic energy projectile 305 has traveled up the gun tube. A major portion of the energetic pusher sabot 310 can be burned away and still support the kinetic energy projectile 305 as it travels up the gun tube. The kinetic energy projectile 305 also comprises projectile rod 20, a nose 25, and a fin 30.

Energetic regions 315, 320, 325, 330 are made of an energetic structural composite that can burn away as the kinetic energy projectile 305 travels up the gun tube. Energetic regions 315, 320, 325, 330 are comprised of energetic structural material such as an Energetic Thermo Plasticizer Elastomer (ETPE), glycidyl azide polymer (GAP) composite with carbon fiber reinforcement.

Energetic regions 315, 320, 325, 330 may also be comprised of a high density polyethylene (HDPE) composite with carbon fiber reinforcement mixed with RDX or HMX or ultem with carbon fiber reinforcement with RDX or HMX. All contain an epoxy resin as a binder that is compatible with the chosen material. Other plastics such as polypropylene that burns may be substituted for the HDPE. Other energetic materials, plasticizers and binders can be used in place of or in addition to the GAP. Some of these materials are nitrocellulose, viton, acetyl triethyl citrate, cellulose acetate buturate and BDNP-AF. These energetic composite structurally strong materials are added to or attached to the sabot.

Figure 5:
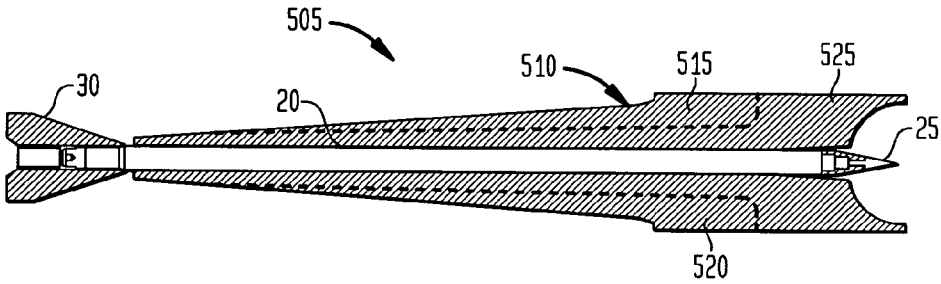
FIG. 5 is a cross-sectional, side view of a KE projectile with an energetic puller sabot illustrating energetic regions.
Figure 6:
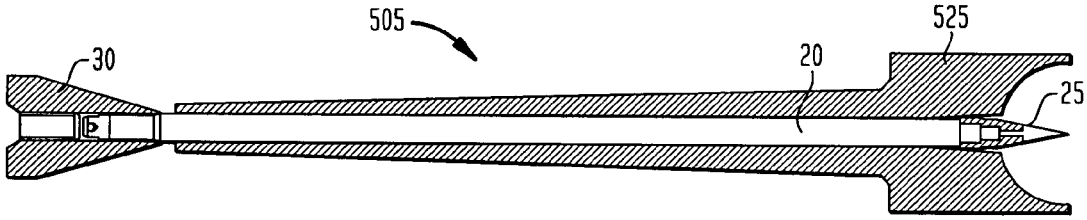
FIG. 6 is a cross-sectional, side view of a KE projectile with an energetic puller sabot after energetic region shave burned away.

Likewise, FIG. 5 and FIG. 6 are cut-away drawings of a KE projectile 505 with a puller sabot 510. FIG. 5 illustrates the size of the energetic puller sabot 510 needed for shot start. Energetic regions 515 and 520 are the part of the energetic puller sabot 510 that is no longer needed for support as the energetic puller sabot 510 travels up the gun tube (not shown). After energetic regions 515 and 520 are burned away, the energetic puller sabot 510 is reduced to the puller sabot base 525.

The puller sabot base 525 (FIG. 6) is the size of energetic puller sabot 510 (FIG. 5) that is needed after the KE projectile 505 has traveled up the gun tube. A major portion of the energetic puller sabot 510 can be burned away and still support the kinetic energy projectile 505 as it travels up the gun tube.

The prediction of the thickness for of the conventional or energetic sabots required before and during launch is performed using a Finite Element Analysis. Finite element analysis is extremely accurate for the design of gun launched sabots when using the pressure/time curves from KE ballistic firings.

The materials used in conventional composite sabot designs are composite plastics reinforced with carbon fibers. They are manufactured by imbedding the carbon fibers in resin and forming a tape called pre-preg. The tape is pressed into the shape of the sabots and then machined to final shape. Other sabots are made of aluminum.

In one embodiment of the energetic pusher sabot 310 and energetic puller sabot 510, the pusher sabot base 335 and puller sabot base 525 are comprised of composite or aluminum. The pusher sabot base 335 and the puller sabot base 525 are manufactured using conventional methods to support the energetic components of the energetic pusher sabot 310 and energetic puller sabot 510, respectively.

A wrap of a composite is applied to the thin sabot (the pusher sabot base 335 or puller sabot base 525) using a spiral wrap machine that winds a carbon thread wetted with a mixture of the energetic composite (for example, GAP or HMX or RDX), epoxy resin and a plastic. The machine that adds the energetic wrap to the pusher sabot base 335 or puller sabot base 525 is a standard machine that makes composite tubes in industry but is upgraded to be explosion proof. The wrap is applied to the pusher sabot base 335 or puller sabot base 525 until the pusher sabot base 335 or puller sabot base 525 takes the shape and thickness of the energetic pusher sabot 310 or energetic puller sabot 510, respectively. If needed, final machining using explosive proof machines in an explosive area is performed on the sabot to get the exact shape desired.

In another embodiment, the energetic pusher sabot 310 and energetic puller sabot 510 are manufactured similar to the method composite sabots are currently made. In the common method for manufacture of composite sabots, a tape is manufactured in sheets by passing a carbon thread through a heated bath of ultem and epoxy resin.

The threads are lined up next to each other and are pulled through the heated resin bath and passed through a roll mill creating a sheet called pre-preg tape. The desired shape of the sabot is cut out of the pre-preg tape and oriented such that the fibers are in different orientations of each other (for example, 30 and 45 degrees). These cut out shapes are placed in an autoclad and pressed into the desired sabot shape.

For the energetic pusher sabot 310, HMX or RDX or other aforementioned energetic materials are added to the sections of the tape used for energetic regions 315, 320, 325, 330 before the cut out shapes for the energetic pusher sabot 310 are put into the autoclave. For the energetic puller sabot 510, HMX or RDX are added to the sections of the tape used for energetic regions 515 and 520 before the cut out shapes for the energetic puller sabot 510 are put into the autoclave. If required, final machining using explosive proof machines in an explosive area is performed on the energetic pusher sabot 310 or energetic puller sabot 510 to obtain the exact shape desired.

In yet another embodiment, a pre-preg tape for energetic regions 315, 320, 325, 330 and energetic regions 515, 520 is made by passing carbon fibers through a heated bath of HDPE (other plastics may be substituted as aforementioned), resin and HMX or RDX or GAP and pulled through a roll mill to make an energetic tape. The energetic tape is placed over the ultem tape made for the pusher sabot base 310 and puller sabot base 510 in the areas that are needed to be energetic. This is done in a way that the sabot bases 335, 525 of the sabot will be standard tape and energetic areas such as 315, 320, 325 and 330 or 515 and 520, depending on the type of sabot you are manufacturing, will be the energetic tape. An overlap region of the standard and energetic tape is allowed.

The ultem tape combined with the energetic tape is passed through a roll mill so that a composite pre-preg tape is made of which part of the tape is energetic. Cut out shapes are made from this pre-preg tape and put into the autoclave so that the energetic portions (energetic regions 315, 320, 325, 330 and energetic regions 515, 520) are oriented in the correct location for timed combustion. The sabot sections are removed from the autoclave. If required, final machining using explosive proof machines in an explosive area is performed on the energetic pusher sabot 310 or energetic puller sabot 510 to obtain the exact shape desired. It should be noted that these sabots are made as three petals that surround and hold the penetrator in the same manner as standard sabots are currently made. A standard force ring that holds the sabots together is later added at projectile assembly.

The energetic pusher sabot 310 and energetic puller sabot 510 gain performance advantage from the introduction of energetic regions 315, 320, 325, 330 and energetic regions 515, 520 that burn away at a controlled rate as the energetic pusher sabot 310 or energetic puller sabot 510 travel up the gun tube. The part of the energetic pusher sabot 310 or energetic puller sabot 510 that is not energetic (i.e., the pusher sabot base 335 and puller sabot base 525) does not burn away but stays intact as it travels up the tube and supports the projectile.

The burn rate of the energetic regions 315, 320, 325, 330 and energetic regions 515, 520 is controlled by controlling the mix portion (for example, the GAP formulation or RDX particle size and amounts of resin) from which that the pre-preg tape is made. Energetic regions 315, 320, 325, 330 and energetic regions 515, 520 are manufactured to provide the structural strength required to support the projectile on shot start and fully support the kinetic energy projectile 305 or kinetic energy projectile 505 as they travel down the tube.

The kinetic energy projectile 305 and kinetic energy projectile 505 become lighter as they travels up the gun tube; consequently they exit the gun tube at a higher velocity than kinetic energy projectiles that contain conventional puller or pusher type sabots. In addition, energetic regions 315, 320, 325, 330 and regions 515, 520 produce propellant gases as they burn away, and subsequently impart energy to the system which causes the projectile to move at a faster velocity.

For some projectiles, on the order of 20% of the weight of the energetic pusher sabot 310 or energetic puller sabot 510 can be burned away as it travels up the gun tube and still provide the necessary support. This reduction of weight of the projectile and the added propellant gases can provide an additional velocity on the order of 70 m/s to the in-flight projectile allowing the penetrator rod 20 from a KE projectile 305, 505 to defeat thicker targets than by utilizing a conventional KE sabot (15 or 210).

It is to be understood that the specific embodiments of the invention that have been described are merely illustrative of certain application of the principle of the present invention. Numerous modifications may be made to the method for reducing the parasitic weight of a kinetic energy projectile invention described herein without departing from the spirit and scope of the present invention.

The invention claimed is:

1. A sabot that reduces a parasitic weight of a kinetic energy projectile including a rod, comprising:

a sabot base; and an energetic region;

wherein the energetic region of the sabot burns away at a controlled rate to reduce the parasitic weight of the kinetic energy projectile as the kinetic energy projectile travels through a gun tube, wherein the energetic region of the sabot is made, at least in part, of a wrap of a composite applied to the sabot base, the wrap being comprised of a carbon thread wet with a mixture of an energetic composite.

2. A sabot that reduces a parasitic weight of a kinetic energy projectile including a rod, comprising:

a sabot base; and an energetic region;

wherein the energetic region of the sabot burns away at a controlled rate to reduce the parasitic weight of the kinetic energy projectile as the kinetic energy projectile travels through a gun tube;

wherein the energetic region of the sabot is made, at least in part, of a pre-preg tape.

3. The sabot of claim 2, further comprising an energetic tape that is placed over an non-energetic pre-preg tape made for the sabot base in the energetic region.

4. A kinetic energy projectile including a rod and a sabot that reduces a parasitic weight of the kinetic energy projectile, the sabot comprising:

a sabot base; and an energetic region;

wherein the energetic region of the sabot burns away at a controlled rate to reduce the parasitic weight of the kinetic energy projectile as the kinetic energy projectile travels through a gun tube, wherein the energetic region of the sabot is made, at least in part, of a wrap of a composite applied to the sabot base, the wrap being comprised of a carbon thread wet with a mixture of an energetic composite.

5. A kinetic energy projectile including a rod and a sabot that reduces a parasitic weight of the kinetic energy projectile, the sabot comprising:

a sabot base; and an energetic region;

wherein the energetic region of the sabot burns away at a controlled rate to reduce the parasitic weight of the kinetic energy projectile as the kinetic energy projectile travels through a gun tube;

wherein the energetic region of the sabot is made, at least in part, of a pre-preg tape.

6. The kinetic energy projectile of claim 5, further comprising an energetic tape that is placed over an non-energetic pre-preg tape made for the sabot base in the energetic region.

* * * * *